US009301586B1

(12) United States Patent
Jones

(10) Patent No.: US 9,301,586 B1
(45) Date of Patent: Apr. 5, 2016

(54) ARISE PONYTAIL HOLDER

(71) Applicant: Franzine Jones, Pikesville, MD (US)

(72) Inventor: Franzine Jones, Pikesville, MD (US)

( * ) Notice: Subject to any disclaimer, the term of this patent is extended or adjusted under 35 U.S.C. 154(b) by 0 days.

(21) Appl. No.: 14/306,249

(22) Filed: Jun. 17, 2014

Related U.S. Application Data

(60) Provisional application No. 61/835,781, filed on Jun. 17, 2013.

(51) Int. Cl.
*A45D 8/26* (2006.01)
*A45D 8/28* (2006.01)
*A45D 8/30* (2006.01)

(52) U.S. Cl.
CPC .. *A45D 8/26* (2013.01); *A45D 8/28* (2013.01); *A45D 8/30* (2013.01)

(58) Field of Classification Search
CPC ..... A41G 5/0073; A44C 15/006; A44C 5/00; A44C 5/12; A45D 2008/004; A45D 6/14; A45D 8/12; A45D 8/20; A45D 8/24; A45D 8/30; A45D 8/26
USPC ..... 132/275
See application file for complete search history.

(56) References Cited

U.S. PATENT DOCUMENTS

| | | | | | |
|---|---|---|---|---|---|
| 2,405,384 | A | * | 8/1946 | White | 362/104 |
| 2,798,148 | A | * | 7/1957 | La Greca et al. | 362/103 |
| 3,126,018 | A | * | 3/1964 | Sidelman | 132/54 |
| 3,790,775 | A | * | 2/1974 | Rosenblatt | 362/104 |
| 3,842,849 | A | | 10/1974 | Goodman | |
| D322,145 | S | * | 12/1991 | Coignard | D28/42 |
| 5,590,668 | A | | 1/1997 | Macy | |
| D385,061 | S | * | 10/1997 | Malik | D28/42 |
| 5,706,837 | A | * | 1/1998 | Iwata | 132/200 |
| 5,769,101 | A | * | 6/1998 | Iwata | 132/273 |
| 5,845,655 | A | * | 12/1998 | Iwata | 132/212 |
| 5,845,657 | A | * | 12/1998 | Carberry et al. | 132/273 |
| 5,950,637 | A | * | 9/1999 | Chang | 132/273 |
| 6,089,240 | A | * | 7/2000 | Chang | 132/273 |
| 6,276,368 | B1 | * | 8/2001 | Giamalva | 132/201 |
| 6,401,726 | B1 | * | 6/2002 | Sonstegard | 132/275 |
| 6,439,242 | B1 | * | 8/2002 | Head et al. | 132/273 |
| 7,882,844 | B2 | | 2/2011 | Chininis et al. | |
| 7,963,289 | B1 | * | 6/2011 | King | 132/200 |
| D680,690 | S | * | 4/2013 | Shyu | D28/41 |
| 8,505,555 | B1 | * | 8/2013 | Lightfoot-Martin | 132/274 |
| 2003/0121526 | A1 | * | 7/2003 | Tobin | 132/276 |
| 2006/0174907 | A1 | * | 8/2006 | Morris et al. | 132/274 |
| 2006/0198120 | A1 | * | 9/2006 | Guzman | 362/103 |
| 2008/0185015 | A1 | * | 8/2008 | Tu | 132/276 |
| 2010/0012138 | A1 | * | 1/2010 | Ruckdeschel | 132/200 |
| 2013/0186424 | A1 | * | 7/2013 | Zachery | 132/275 |
| 2014/0290682 | A1 | * | 10/2014 | Wendschuh | 132/200 |
| 2014/0311520 | A1 | * | 10/2014 | McConnell-Gill | 132/275 |

* cited by examiner

*Primary Examiner* — Rachel Steitz
*Assistant Examiner* — Jennifer Gill
(74) *Attorney, Agent, or Firm* — Law Office of Jerry Joseph, PLC

(57) ABSTRACT

A ponytail holder includes a first body member, a second body member movably coupled to the first body member with a hinge member, and a fastening member to secure the first body member to the second body member, wherein the first body member and the second body member form a conical shape, in a closed state.

3 Claims, 9 Drawing Sheets

ARISE PONYTAIL HOLDER

CROSS-REFERENCE TO RELATED APPLICATIONS

This application claims the benefit of U.S. Provisional Patent Application No. 61/835,781, filed on Jun. 17, 2013, the disclosure of which is incorporated herein in its entirety by reference.

BACKGROUND OF THE INVENTION

1. Field of the Invention

The present general inventive concept relates to hair accessories and more particularly to a ponytail holder clamp having a conical shape to help lift a user's hair. The ponytail holder clamp according to the present general inventive concept holds the user's hair up and away from the user's head and also conceals a hair extension attachment point.

2. Description of the Related Art

As with all types of fashion, hairstyles change regularly over time. However, of the many hair styles over the years, the ponytail has remained as one of the most popular and versatile looks for many people. A ponytail is typically formed when a user gathers together some or most of their hair into a bundle, pulls the bundle away from his or her face, and then secures the bundle with a hair tie or an elastic band. The ponytail hair style, although simple to create, is popular among men and women of all ages.

However, when wearing a ponytail, users often have an issue with their ponytails coming into contact with their heads and neck. Although various devices have been developed, all of which were merely intended to enhance an appearance or a wearability of the ponytail for the user. However, while these device may be suitable for their intended applications, none of which solve the various problems addressed by the present general inventive concept.

This background is not intended to be an aid in determining the scope of the claimed subject matter nor be viewed as limited the claimed subject matter to implementations that may solve the disadvantages or issues presented above. This background is provided to introduce context for the Summary and the Detailed Description provided herein.

BRIEF SUMMARY OF THE INVENTION

A ponytail holder includes a first body member, a second body member movably coupled to the first body member with a hinge member; and a fastening member to secure the first body member to the second body member, wherein the first body member and the second body member form a conical shape, in a closed state.

The fastening member may include one of a clip, a magnet, and a latch to secure the first body member to the second body member, in the closed state.

The pony tail holder may further include a plurality of lights disposed on at least one of the first body member and the second body member.

The pony tail holder may further include a mic and a controller coupled to the plurality of lights, wherein the controller controls the plurality of lights based on a sound received by the mic.

The pony tail holder may further include one of a fabric material and artificial hair coupled to the first and second body members.

BRIEF DESCRIPTIONS OF THE DRAWINGS

These and/or other utilities and aspects of the present general inventive concept will become apparent and more readily appreciated from the following description of the exemplary embodiments, taken in conjunction with the accompanying drawings of which:

DETAILED DESCRIPTION OF THE INVENTION

Figure 1:
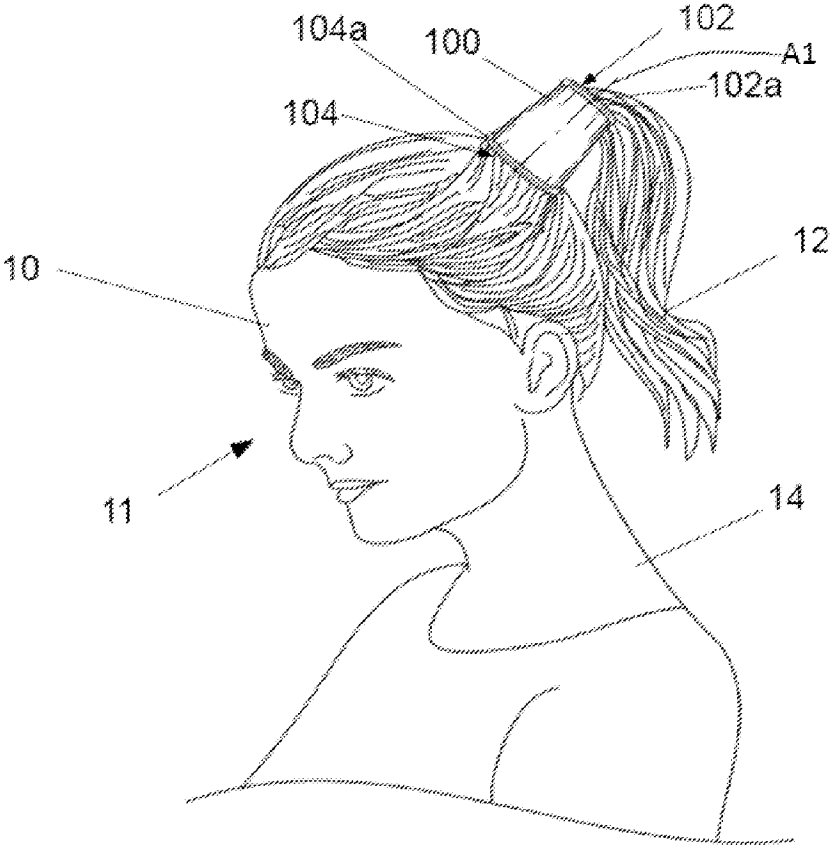
FIG. 1 is a front perspective view of a pony tail holder according to an exemplary embodiment of the present general inventive concept, assembled on a user.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures. However, the present general inventive concept may be embodied in many different forms and should not be construed as limited to the exemplary embodiments set forth herein; rather these embodiments are provided so that this disclosure will be thorough and complete, and will convey the scope of the present general inventive concept to those skilled in the art.

Figure 2:
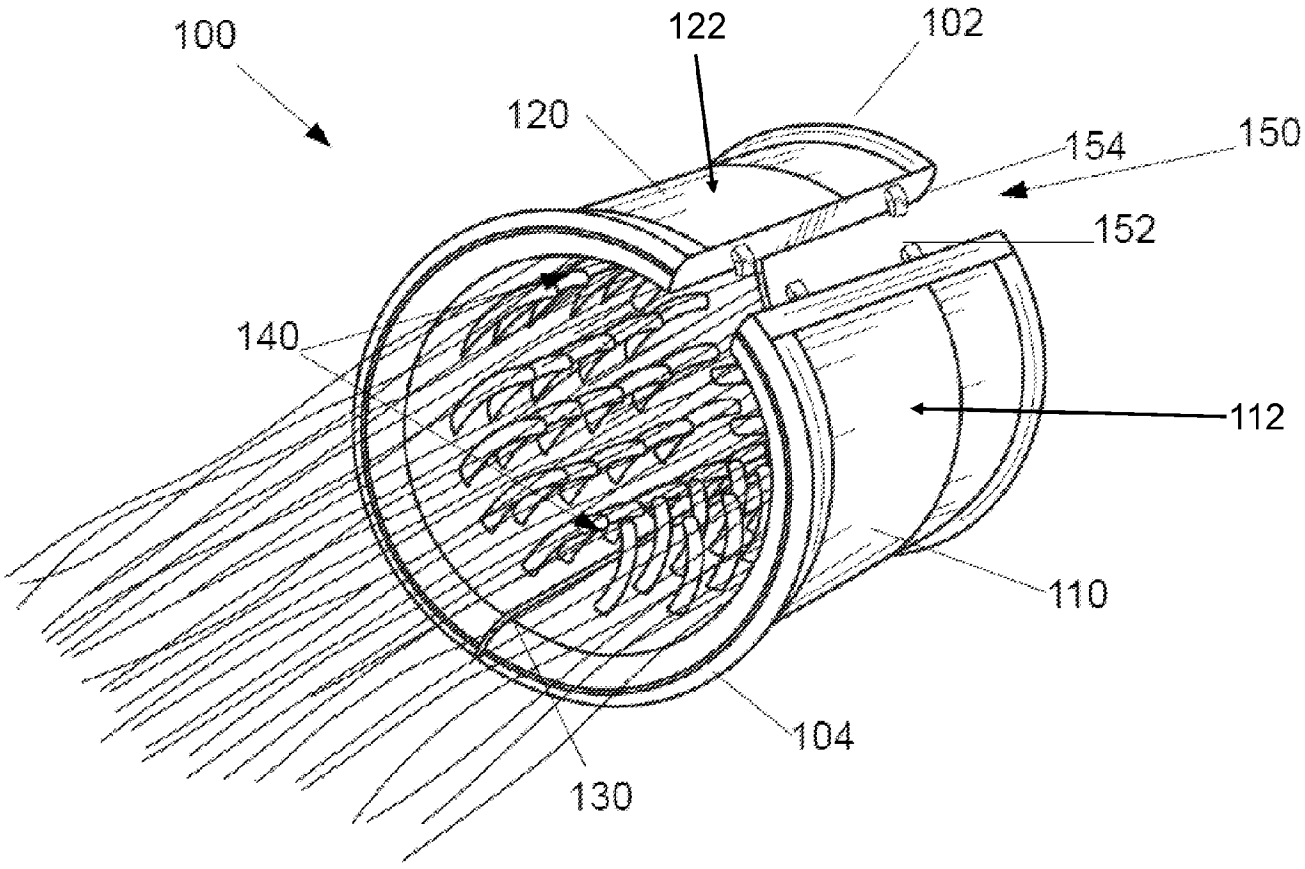
FIG. 2 is a bottom perspective view of the pony tail holder illustrated in FIG. 1, in an open state.
Figure 3:
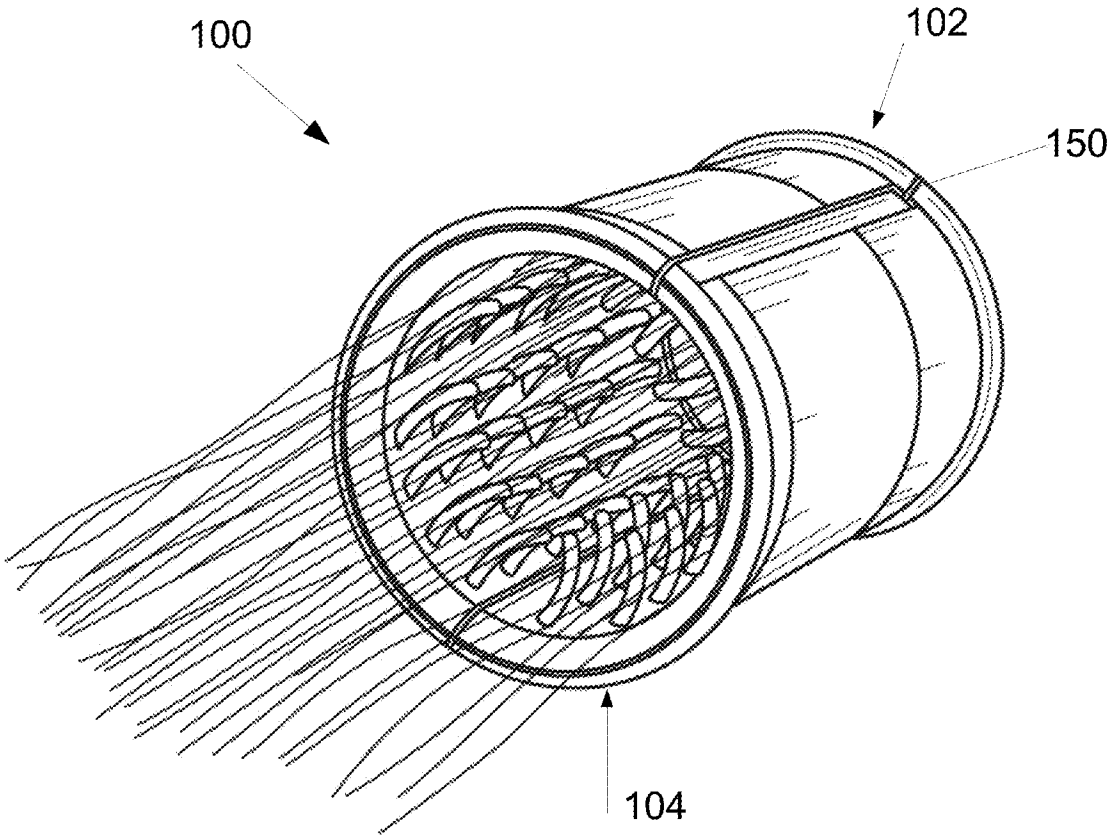
FIG. 3 is a bottom perspective view of the pony tail holder illustrated in FIG. 1, in a closed state.

FIG. 1 is a front perspective view of a pony tail holder 100 according to an exemplary embodiment of the present general inventive concept, assembled onto a user 10. FIG. 2 is a front perspective view of the pony tail holder 100 illustrated in FIG. 1, in an open state. FIG. 3 is a front perspective view of the pony tail holder 100 illustrated in FIG. 1, in a closed state.

Referring to FIGS. 1-3, the ponytail holder 100 according to an exemplary embodiment of the present general inventive concept includes a first body member 110 coupled to a second body member 120 through a hinge member 130. The ponytail holder 100 includes a first end 102 (i.e., top end) and an opposing second end 104 (i.e., bottom end). When the ponytail holder 100 is in a closed state, an outer surface 112 of the first body member 110 and an outer surface 122 of the second body member 120 form a conical shape. (See FIG. 6A).

Referring to FIG. 1, the user 10 has pulled her hair together to create a ponytail 12 behind her head 11. The user 10 may place an elastic band (not illustrated) around the ponytail 12 to secure the hair within the ponytail 12 in place. In an exemplary embodiment, the pony tail holder 100 may be assembled onto the user's 10 ponytail 12 such that the second end 104 of the pony tail holder 100 is in contact with the user's 10 head 11. The ponytail 12 is inserted within a cavity formed between the first and second body members 110, 120. The ponytail holder 100 is affixed to the user's 10 hair in such a manner so as to conceal the elastic band and also to hold the user's ponytail 12 up and away from the user's head 11 and neck 14.

In exemplary embodiments, the ponytail holder 100 further includes a rounded ridge member 102*a*, 104*a*, located at the first end 102 and second end 104 to provide a smooth transition for the user's 10 hair. In the present exemplary embodiment, the rounded ridge members 102*a*, 104*a* are disposed around the entire perimeter of the pony tail holder 100. However, the present general inventive concept is not limited thereto.

Figure 4:
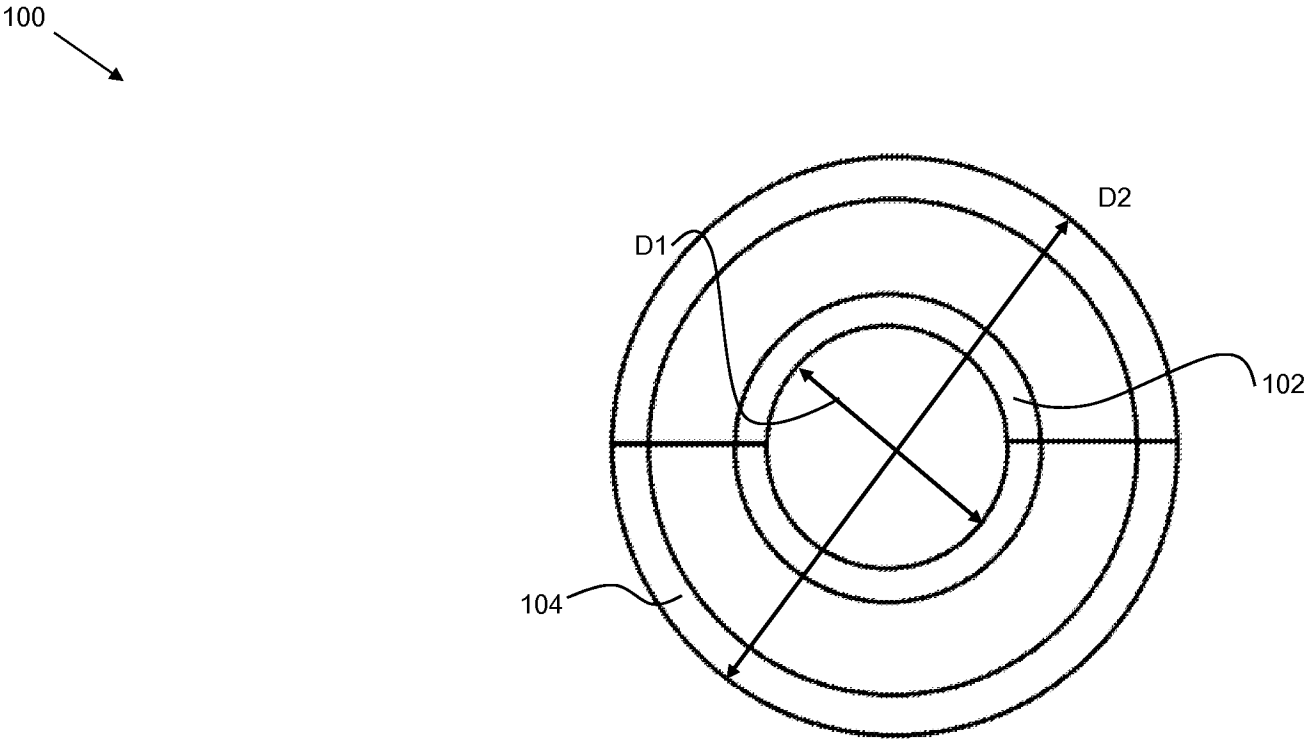
FIG. 4 is a schematic top plan view of the pony tail holder illustrated in FIG. 1, in a closed state.

FIG. 4 is a schematic top plan view of the pony tail holder 100 illustrated in FIG. 1, in a closed state.

Referring to FIG. 4, in the present exemplary embodiment, the first end 102 has a first diameter D1 and the second end has a second diameter D2. The first diameter D1 is substantially less than the second diameter D2, to thereby form the conical shape illustrated in FIG. 6A. In the present exemplary embodiment, the first diameter is about 1 inch and the second diameter D2 is greater than 1.5 inches. However, the present general inventive concept is not limited thereto.

In the present exemplary embodiment, the ponytail holder 100 has a height H1 which is greater than about 1.5 inches. The combined conical shape and height H1 allows the ponytail holder 100 according to the present general inventive concept to support the user's hair in a raised position, away from the user's head 11, thereby substantially reducing the tips of the user's hair from contacting his or her head 11 and neck 14. In addition, the angle which the hair is supported away from the user's head 11, created by the conical shape of the ponytail holder 100 increases an esthetic appearance of the user and increases the appearance of fullness of the user's ponytail 12.

Referring to FIG. 2, the ponytail holder 100 further includes a plurality of teeth 140 facing a central axis A1 of the ponytail holder 100. When the ponytail holder 100 is in a closed state around the user's hair, the plurality of teeth 140 enters the hair to thereby securely hold the ponytail holder 100 onto the user's 10 hair. The plurality of teeth 140 may be integrally formed on the inner surfaces 114, 124 of the first and second body members 110, 120, respectively.

In exemplary embodiments, a cross-section of the plurality of teeth 140 is one of the following shapes circular, triangular, and rectangular. However, the present general inventive concept is not limited thereto. That is, in alternative exemplary embodiments, the plurality of teeth 140 may be formed in various shapes, including but not limited to, being pointed, rounded, or squared off.

In yet further exemplary embodiments, the plurality of teeth 140 disposed on the first body member 110 may optionally intermesh with the plurality of teeth 140 disposed on the second body member 120. However, the present general inventive concept is not limited thereto. That is, the plurality of teeth 140 may vary in length and shape to either enlarge or reduce an opening along a longitudinal axis of the ponytail holder 100. In alternative exemplary embodiments, a portion of the plurality of teeth 140 may be spring-loaded to thereby automatically adjust to varying sizes of hair bundles clamped by the ponytail holder 100.

In exemplary embodiments, the ponytail holder 100 may further include a fastening member 150 to secure the first and second body members 110, 120 together. The fastening member 150 includes a latching member 152 attached to an end of the first body member 110 and a locking member 154 attached to an end of the second body member 120. In exemplary embodiments, the fastening member 150 includes clips, snaps, magnetic connectors, buttons, and any combinations thereof.

In operation, the user 10 opens the pony tail holder 100 to the open state, as illustrated in FIG. 2, by unlocking the fastening member 150 and then separating the first body member 110 from the second body member 120. The user 10 then places the opened pony tail holder 100 around the ponytail 12, so that the bottom end 104 of the ponytail holder 100 is adjacent to the user's 10 head. As the pony tail holder 100 is closed, as illustrated in FIG. 2, the plurality of teeth 140 disposed on the inner surface 114 and 124 of the first and second body members 110, 120 are inserted into the user's 10 hair.

Figure 5:
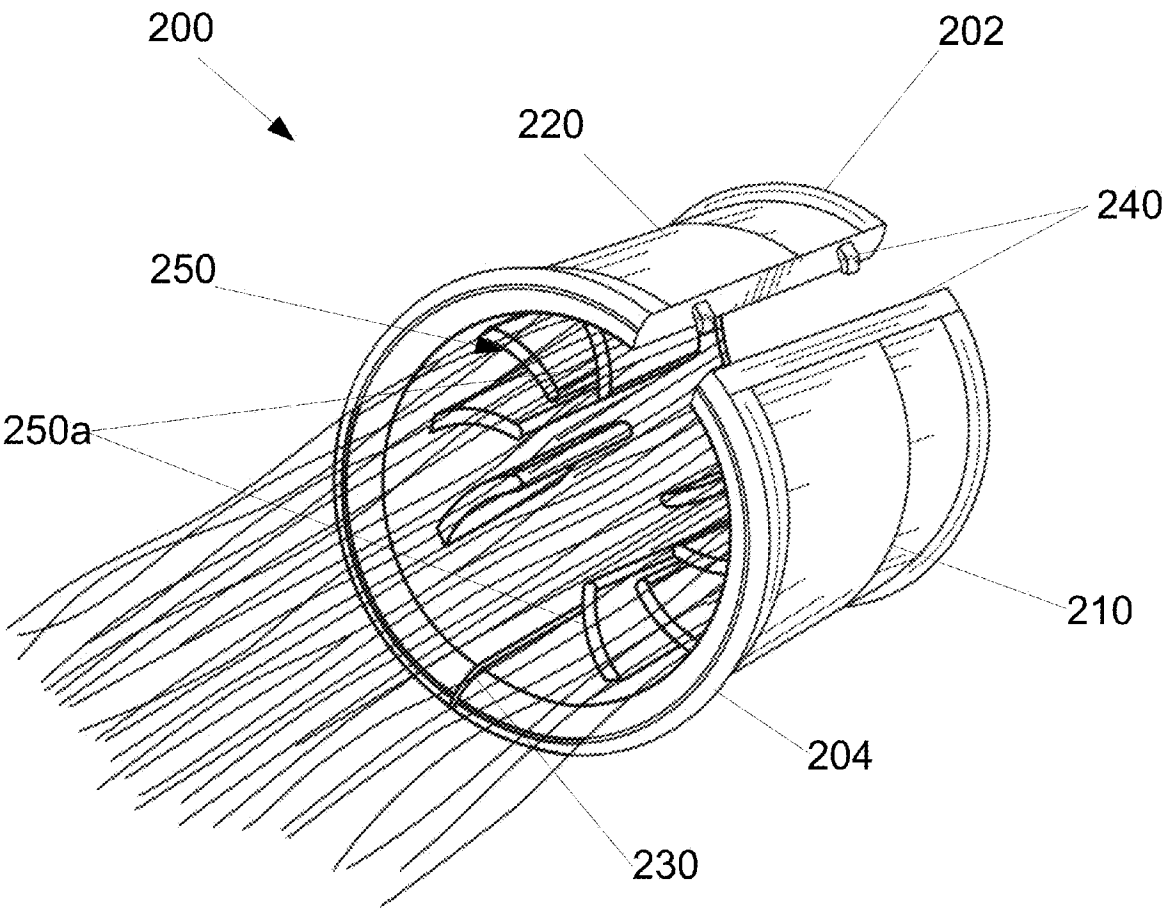
FIG. 5 is a bottom perspective view of a pony tail holder according to an exemplary embodiment of the present general inventive concept, in an open state.
Figure 6:
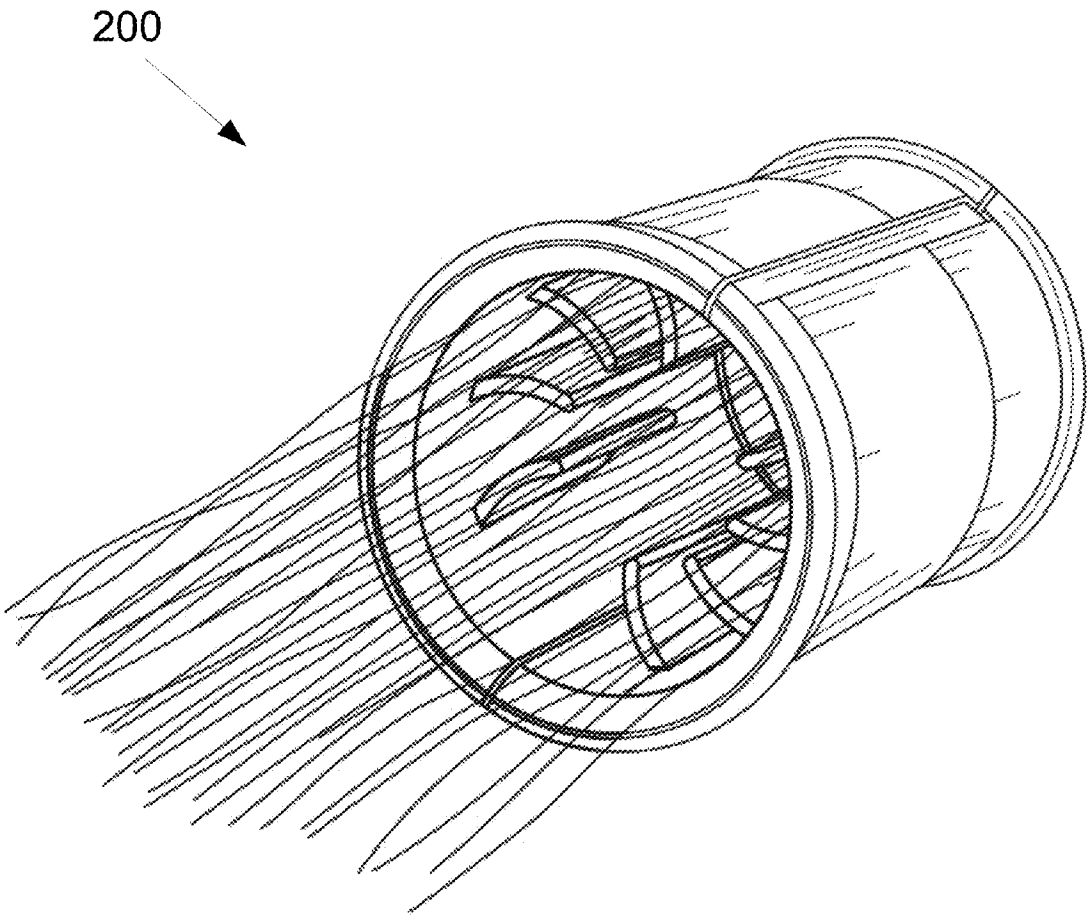
FIG. 6 is a bottom perspective view of the pony tail holder illustrated in FIG. 4, in a closed state.

FIG. 5 is a front perspective view of a pony tail holder 200 according to another exemplary embodiment of the present general inventive concept, in an open state. FIG. 6 is a front perspective view of the pony tail holder 200 illustrated in FIG. 5, in a closed state.

Referring to FIGS. 5 and 6, a pony tail holder 200 according to another exemplary embodiment is substantially similar to the previous exemplary embodiments, except for the plurality of teeth 250. In the present exemplary embodiment, the pony tail holder 200 includes a plurality of elongated teeth 250 which include curved portions 250*a* disposed within the first and second body members 210, 220. The curved portions 250*a* allow the plurality of teeth 250 to more easily insert within the user's pony tail.

Figures 7, 7A, 7B, 7C:
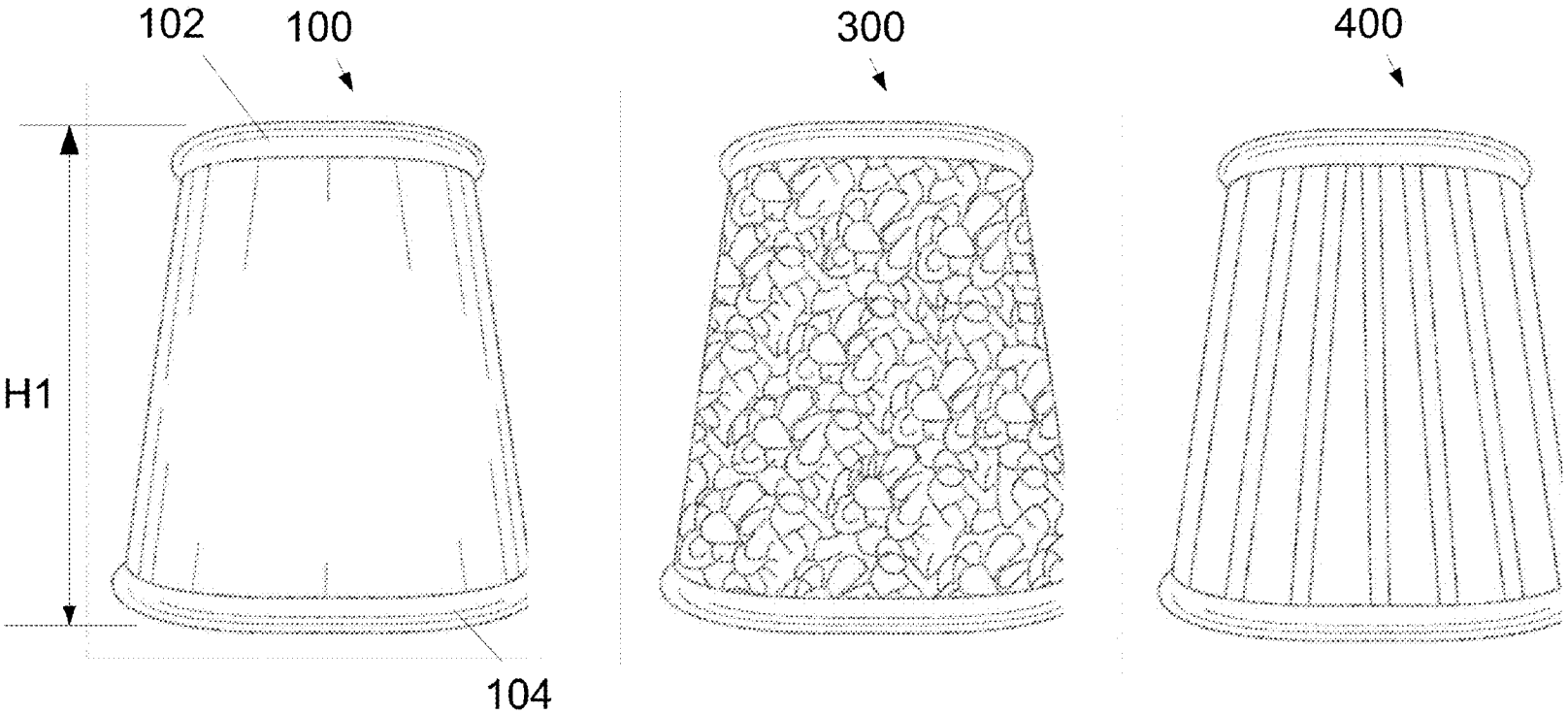
FIG. 7A is a side plan view of a pony tail holder according to another exemplary embodiment of the present general inventive concept.
FIG. 7B is a side plan view of a pony tail holder according to another exemplary embodiment of the present general inventive concept.
FIG. 7C is a side plan view of a pony tail holder according to another exemplary embodiment of the present general inventive concept.

FIG. 7A is front view of a pony tail holder 100 according to another exemplary embodiment of the present general inventive concept. FIG. 7B is front view of a pony tail holder 300 according to another exemplary embodiment of the present general inventive concept. FIG. 7C is front view of a pony tail holder 400 according to another exemplary embodiment of the present general inventive concept.

In exemplary embodiments, the outer surface 112, 122 of the first and second body members 110, 120 may be covered with various materials including fabric, artificial hair, mirrors, or jewelry. However, the present general inventive concept is not limited thereto.

Figure 8:
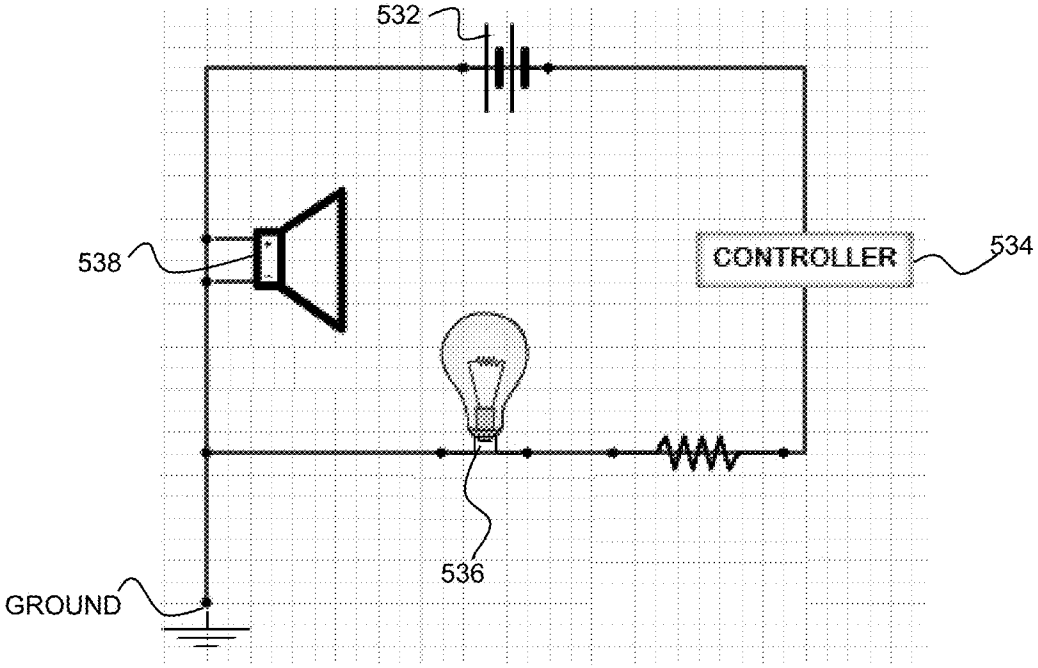
FIG. 8 is a schematic diagram illustrating a circuit according to an exemplary embodiment of the present general inventive concept.
Figure 9:
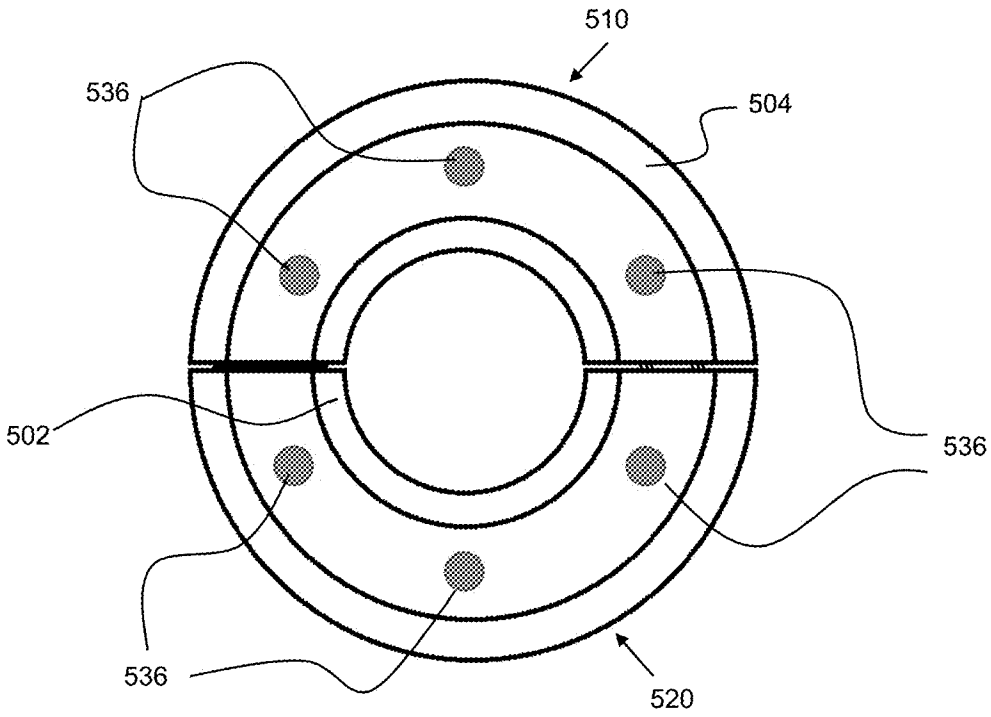
FIG. 9 is a schematic top view of a pony tail holder according to an exemplary embodiment of the present general inventive concept.

FIG. 8 is schematic front view of a pony tail holder 500 according to another exemplary embodiment of the present general inventive concept.

In the present exemplary embodiment, the pony tail holder may include a top end 502, bottom end 504, and a plurality of lights 536 disposed on the outer surface of the first and second body members 510, 520. The pony tail holder 500 may further include a controller 534 which turns on and off the plurality of lights 536 to match a beat of music or other sounds. The plurality of lights 536 may include LEDs or the like.

The pony tail holder 500 may further include a mic 538 to provide signals to the controller 534 in order to allow the plurality of lights 536 to match a beat of sound or music.

The pony tail holder 500 may further include a speaker (not illustrated) to play a music or sound using the controller.

The present general inventive concept provides a conical shaped ponytail holder to lift the users hair up and away from their head. However, the present general inventive concept is not limited thereto.

Additional aspects and utilities of the present general inventive concept will become apparent to those skilled in the art upon reference to the detailed description taken in conjunction with the provided figures. Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A ponytail holder comprising:

a first body member having a first top end and an opposite second bottom end;

a second body member having a first top end and an opposite second bottom end, the first and second body members each having a rounded edge member at each of the first top and second bottom ends, the second body member movably coupled to the first body member with a hinge member disposed on a first side surface of each of the first and second body members, wherein one of a fabric material, a mirror, jewelry, or artificial hair covers an exterior surface of the first and second body members;

a plurality of teeth integrally formed on an interior surface of the first and second body members; and a fastening member disposed only on a second side surface of the first and second body members to secure the first body member to the second body member, wherein the second side surface of each of the first and second body members is opposite the first side surface of each of the first and second body members, wherein the first body member and the second body member form a conical shape, in a closed state defined when the second side surfaces are fastened together with the fastening members, and the plurality of teeth are formed in a rounded arc-shape and configured to enter a user's hair, wherein the first top end of the first body member and the first top end of the second body member combine to form a top of the conical shape, and wherein in the closed state, the exterior surface of the first and second body members form a smooth and continuous surface and a diameter of the second bottom end of each of the first and second body members is greater than 1.5 inches.

2. The pony tail holder of claim 1, wherein the fastening member includes one of a clip, a magnet, and a latch to secure the first body member to the second body member, in the closed state.

3. The ponytail holder of claim 1, wherein a cross-section of each tooth of the plurality of teeth is one shape of circular, triangular, and rectangular.

* * * * *